US006205738B1

(12) United States Patent
Chen

(10) Patent No.: US 6,205,738 B1
(45) Date of Patent: Mar. 27, 2001

(54) FRAME FOR FORMING A HOUSING OF A GROUP OF AIR-HANDLING UNITS

(75) Inventor: Tsai Chi Chen, Taipei (TW)

(73) Assignee: Yang Fan Development Co., Ltd., Taipei (TW)

( * ) Notice: Subject to any disclaimer, the term of this patent is extended or adjusted under 35 U.S.C. 154(b) by 0 days.

(21) Appl. No.: 09/280,684

(22) Filed: Mar. 29, 1999

(51) Int. Cl.[7] ..... E04C 3/28

(52) U.S. Cl. ..... 52/653.2; 52/655.1; 52/656.9; 312/265.4; 403/170

(58) Field of Search ..... 52/653.1, 653.2, 52/655.1, 656.9; 312/265.1, 265.4; 403/170, 176, 205, 231, 403

(56) References Cited

U.S. PATENT DOCUMENTS 3,044,656 * 7/1962 Combs et al. ..... 312/265.1 X
3,353,854 * 11/1967 Hansen ..... 52/656.9 X
3,877,138 * 4/1975 Suchowski ..... 52/656.9 X
4,516,376 * 5/1985 King ..... 52/655.1 X
4,782,637 * 11/1988 Eriksson et al. ..... 52/653.1 X
4,900,108 * 2/1990 Tischer ..... 312/265.4 X
5,011,323 * 4/1991 Liuo ..... 403/403 X
5,516,225 * 5/1996 Kvols ..... 312/265.1 X

* cited by examiner

*Primary Examiner*—Carl D. Friedman
*Assistant Examiner*—Kevin D. Wilkens
(74) *Attorney, Agent, or Firm*—Dougherty & Troxell

(57) ABSTRACT

A frame for forming a housing of a group of air-handling units mainly includes a plurality of extruded plastic angle columns and a plurality of integrally injection molded plastic three-way unions. The plastic angle columns and three-way unions eliminate the problem of condensate on the surfaces of the housing and allow the air-handling units to operate with reduced energy consumption, because the plastic columns and unions have low coefficient of thermal conduction and would not easily have a surface temperature lower than a dew point temperature of ambient air outside the housing. Meanwhile, the extruded plastic angle columns and the injection molded plastic three-way unions can have standardized dimensions and be efficiently produced through mass production, the frame for the housing of the air-handling units can therefore be formed at reduced labor and time.

4 Claims, 7 Drawing Sheets

FRAME FOR FORMING A HOUSING OF A GROUP OF AIR-HANDLING UNITS

BACKGROUND OF THE INVENTION

The present invention relates to a frame for forming a housing of a group of air-handling units, and more particularly to a frame including extruded plastic angle column and integrally injection molded plastic three-way union for forming a housing of a group of air-handling units. The angle column and the three-way union of the present invention may effectively solve the problem of condensate on the housing of the air-handling units and therefore reduces energy consumption by the air-handling units.

FIG. 1 illustrates a conventional housing for a group of air-handling units. As shown, the housing includes a frame that is constructed by welding required numbers of angle steel columns 1 to enclose the air-handling units. Wall panels 11 are then attached to outer sides of the angle steel columns 1. Following are some disadvantages of the above-described conventional housing for the air-handling units:

1. It is extremely time and labor consumed to weld the angle steel columns 1 into a frame and connect the frame to the air-handling units. The frame so formed therefore requires higher production cost.
2. Due to the effects of air convection and high coefficient of thermal conduction of the angle steel column, the panels 11 and the frame 1 tend to have a surface temperature lower than a dew-point temperature of the ambient air outside the housing of the air-handling units. This condition causes condensate on the housing of the air-handling units and brings troubles to manufacturers and users.
3. There are various types of air-handling units in the markets from three to several hundred tons of refrigeration. The angle steel columns 1 further increase the volume and weight and accordingly the difficulty of transportation of the air-handling units.

It is therefore desirable to develop a frame including plastic angle columns and unions for constructing the housing of the air-handling units to eliminate the disadvantages existing in the conventional housing formed from welded angle steel columns.

SUMMARY OF THE INVENTION

A primary object of the present invention is to provide an improved frame including plastic hollow angle columns and plastic three-way unions that can be easily assembled to form a housing of a group of air-handling units. The plastic hollow angle column has low coefficient of thermal conduction and defines closed internal spaces in which static air exists to provide good heat insulation. The problem of condensate on the surfaces of the frame 1 and the panels 11 of the housing for the air-handling units can therefore be effectively solved.

Another object of the present invention is to provide a frame including plastic hollow angle columns and plastic three-way unions that can be easily assembled to form a housing of a group of air-handling units. Chemical adhesive such as Methyl Benzene may be applied to joints between the plastic angle columns and the plastic three-way unions to firmly adhered them to one another, preventing separated joints possibly caused by vibration force applied on the frame by the air-handling units during operation or transportation. The firmly joined plastic angle columns and three-way unions also prevent undesired leaks on the housing of the air-handling units and accordingly leakage of cool air from the housing when the air-handling units are in operation.

A further object of the present invention is to provide a frame including plastic hollow angle columns and plastic three-way unions that can be easily assembled to form a housing of a group of air-handling units after the units have been sent to a construction site. The difficulty in transporting a group of bulky and heavy air-handling units can therefore be eliminated. In the case of replacing a group of old air-handling units with a new units in a building, the plastic angle columns may be cut to required lengths at the construction site to meet the actual dimensions of space for mounting the air-handling units and avoid the trouble of knocking off any part of the building.

The installation of the air-handling units can therefore be simplified and accomplished with reduced labor and time.

BRIEF DESCRIPTION OF THE DRAWINGS

The above and other objects and the features and functions of the present invention can be best understood by referring to the following detailed description of the preferred embodiments and the accompanying drawings and attachments, wherein.

DETAILED DESCRIPTION OF THE PREFERRED EMBODIMENTS

Figure 1:
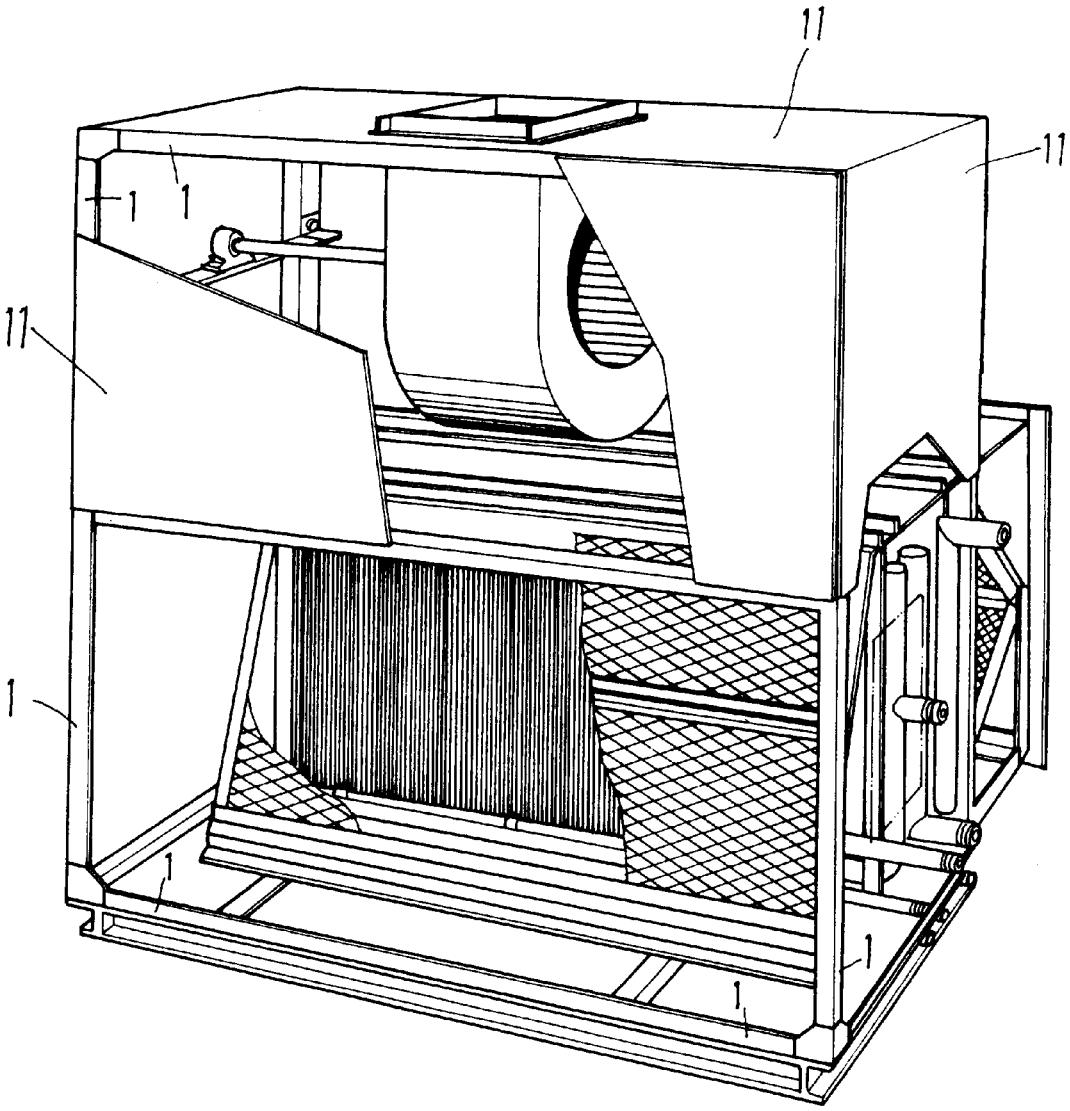
FIG1 PRIOR ART
FIG. 1 illustrates a group of air-handling units enclosed in housing having a frame formed by welding angle steel columns together.
Figure 2:
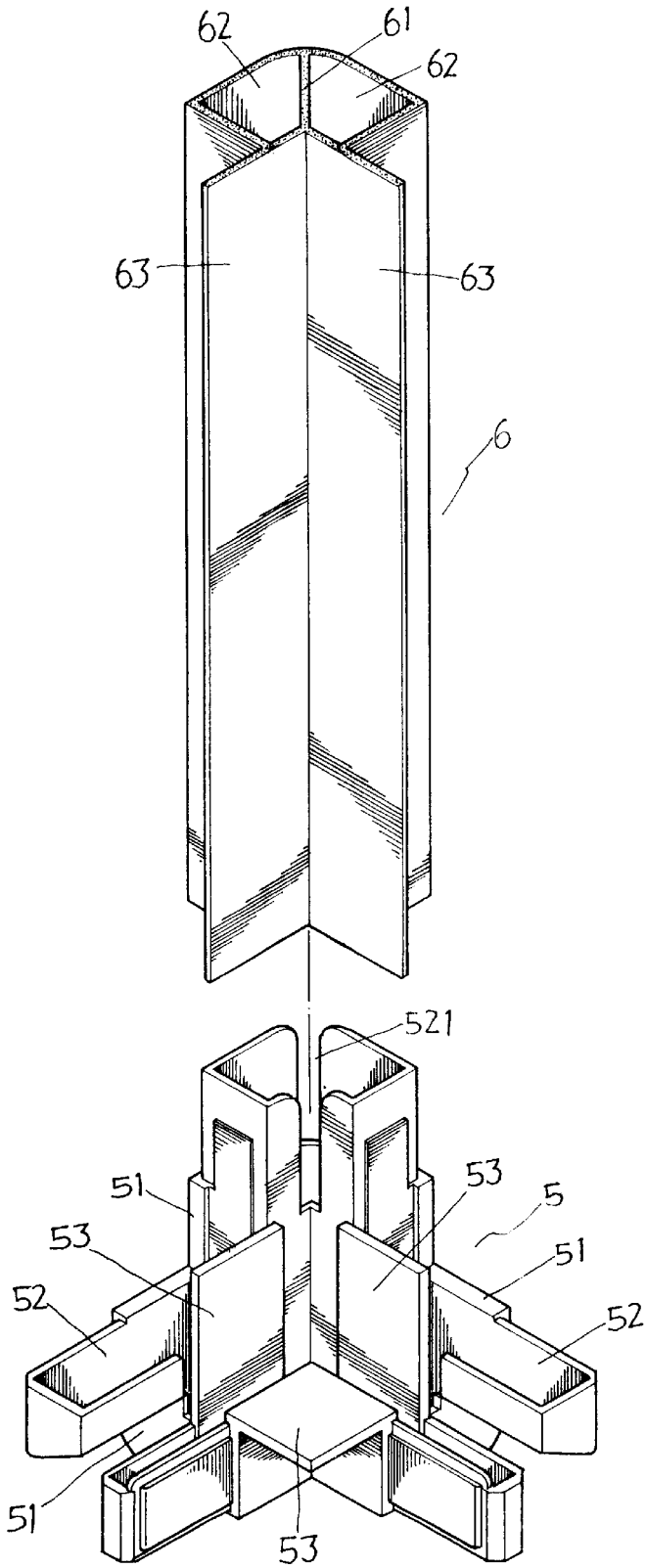
FIG. 2 shows a plastic three-way union and a plastic angle column according to the present invention for forming the housing of a group of air-handling units.

Please refer to FIG. 2. The present invention relates to a frame including a plurality of plastic three-way unions 5 and a plurality of plastic angle columns 6 for forming a housing of a group of air-handling units.

The plastic angle column 6 is made of plastic material by way of extrusion. Each plastic angle column 6 includes a main body and two axially extended reinforcing wings 63. The main body includes a right-angled front surface and two side surfaces that together with the front surface define a hollow space in the main body. An axially extended middle rib 61 in the main body divides the hollow space into two small, symmetrical, and close spaces 62. Static air in the two close spaces 62 is an excellent heat insulator and therefore enables the plastic hollow angle column 6 to have enhanced thermal insulating effect. The two reinforcing wings 63 radially project from a rear edge of the middle rib 61 to contain a right angle between them.

The plastic three-way union 5 is integrally formed from plastic material by way of injection molding. Each plastic three-way union 5 mainly includes a right-angled and generally T-shaped base 51 defining three front surfaces in X-axis, Y-axis, and Z-axis directions, three connection legs 52 integrally connected to and extended from a rear side of the three front surfaces 51, and three reinforcing plates 53 provided to root portions of the connection legs 52. Two of the three reinforcing plates 53 are in vertical position and abut against a rear side of the two connection legs 52 separately extended in X and Y axis directions, and the third reinforcing plate 53 is in horizontal position and has two adjacent edges abutting against the connection leg 52 extended in Z-axis direction. The connection leg 52 has a contour corresponding to but slightly smaller than that of the main body of the plastic hollow angle column 6, and a middle spacing slot 521 corresponding to the middle rib 61, such that the three-way union 5 and the angle column 6 can be firmly connected to one another in a tight fit relation by inserting the connection leg 52 into the two symmetrical spaces 62 of the hollow angle column 6 with the middle spacing slot 521 engaging with the middle rib 61 and the reinforcing plates 53 fitly abutting on the reinforcing wings 63 end to end. The reinforcing plates 53 and the reinforcing wings 63 provide positions for front panels 11 mounted on the frame to complete the housing of the air-handling units.

Figure 3:
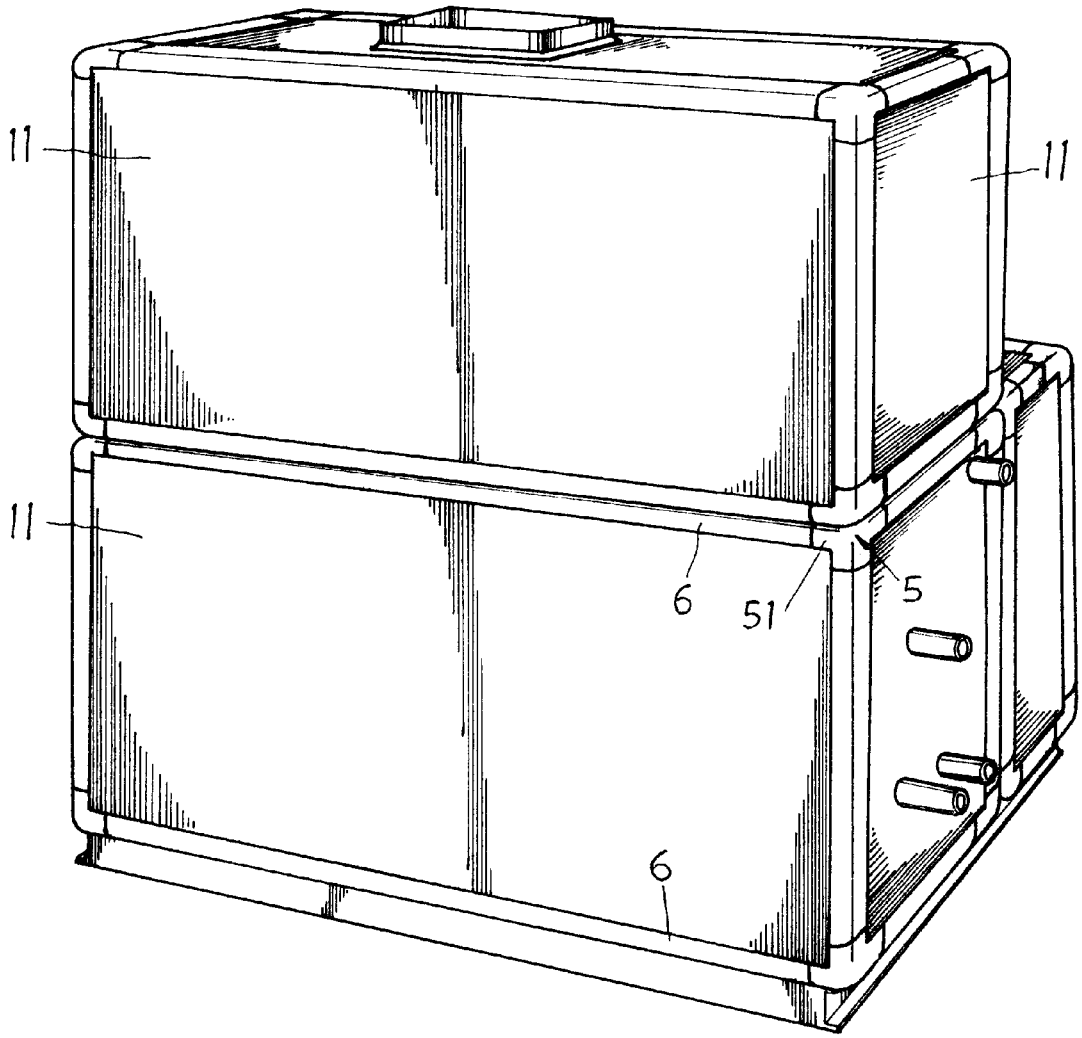
FIG. 3 illustrates a housing of a group air-handling units having a frame constructed from the plastic angle columns and three-way unions of FIG. 2.

FIG. 3 illustrates a housing assembled from the three-way unions 5 and the angle columns 6 of the present invention as well as front panels 11 to house a group of air-handling units. The three-way unions 5 and the angle columns 6 enable the construction of standardized housing that can be easily and quickly assembled in high efficiency with reduced labor and time. What is to be noted is chemical adhesive, such as Methyl Benzene, may be applied on contact areas of the plastic three-way unions 5 with the plastic angle columns 6, so that the three-way unions 5 and the angle columns 6 firmly adhere to one another and form a unitary body. Such adhesive applying procedure further ensures solid connection of the three-way unions 5 to the angle columns 6 without the risk of separating from one another and the housing of the air-handling units can therefore be effectively protected against any leak and undesirable leakage of cool air from the air-handling units via the leak.

Experiments have been conducted to test actual effects of the plastic three-way union 5 and the plastic hollow angle column 6 on solving the problem of condensate on surfaces of the housing of the air-handling units.

Plastic material has a coefficient of thermal conduction of 0.852 watt/m ° C. that is much lower than a coefficient of thermal conduction of 210.097 watt/m ° C. for carbon steel. This means the plastic three-way union 5 and the plastic angle column 6 would be more effective than angle steel column 1 in preventing heat transfer from outside to inside of the housing of the air-handling units via the frame.

Figure 4:
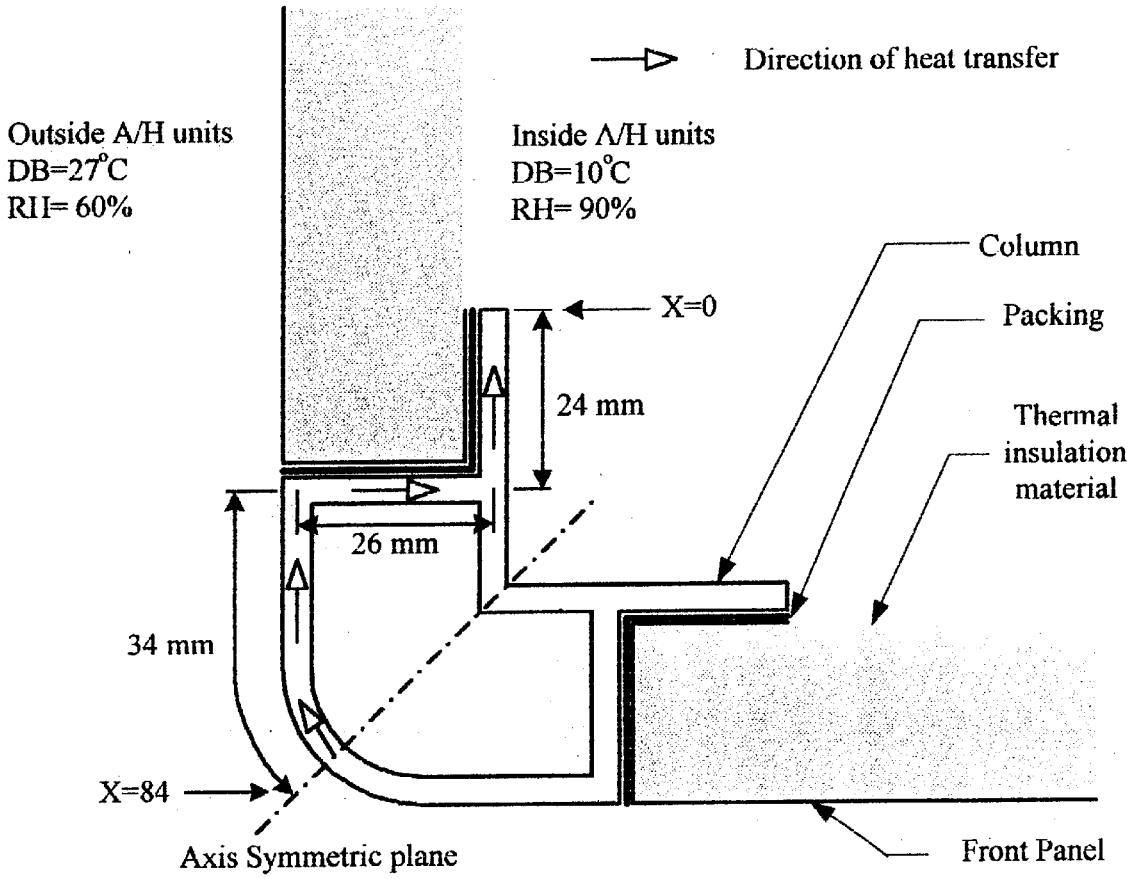
FIG. 4 is a fragmentary sectional view showing the plastic hollow angle column of the present invention subjected to a first thermal conduction test under temperature conditions of 10° C. inside and 27° C. outside the housing of the air handling units.
Figure 5:
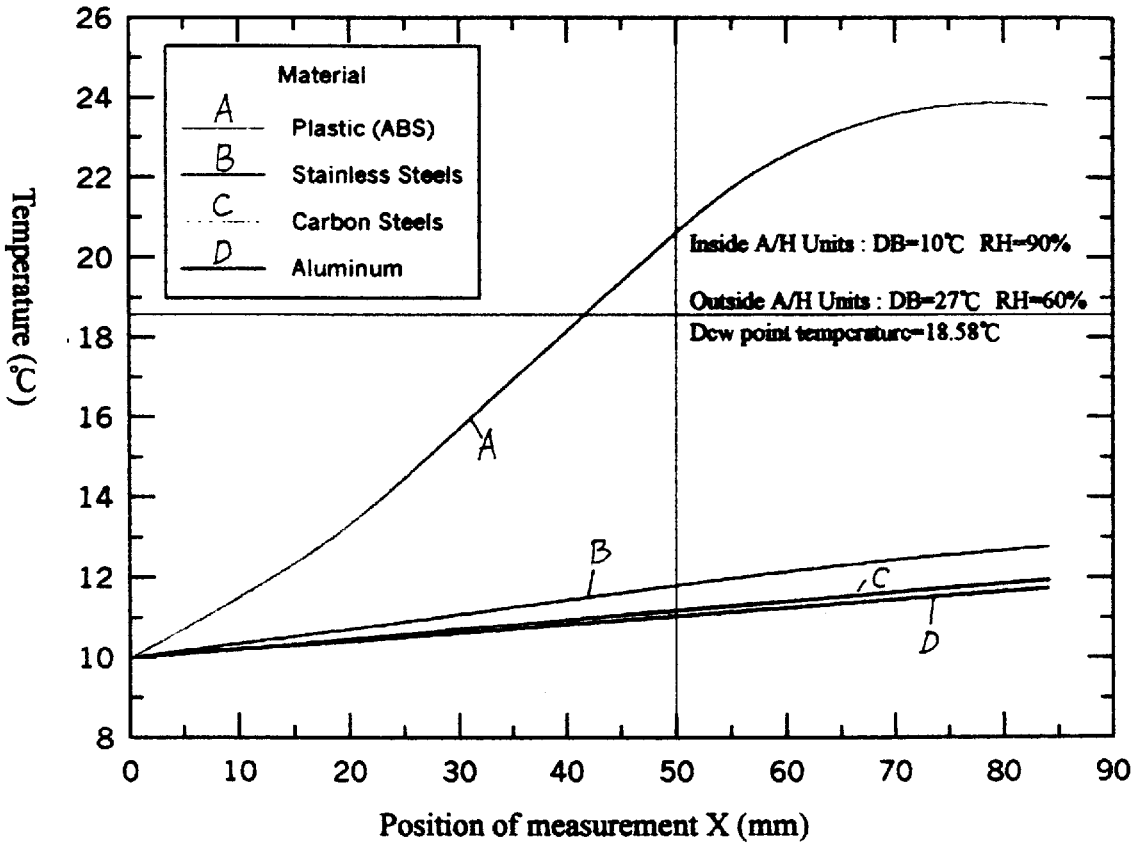
FIG. 5 is a graph comparing the influence of angle columns made of different materials on the condensation condition on surfaces of the housing of the air-handling units under temperature conditions of 10° C. inside and 27° C. outside the housing of the air handling units.

A first specific thermal conduction test is conducted for housings of air-handling units with the respective frames thereof made of different materials, including plastic material as adopted by the present invention, under conditions of an ambient air dew point temperature of 18.58° C., and a dry bulb temperature of 10° C. and a relative humidity of 90% inside the housing of the air-handling units relative to a dry bulb temperature of 27° C. and a relative humidity of 60% outside the housing of the air-handling units. FIGS. 4 and 5 show the method and the results, respectively, of the first test.

Figure 6:
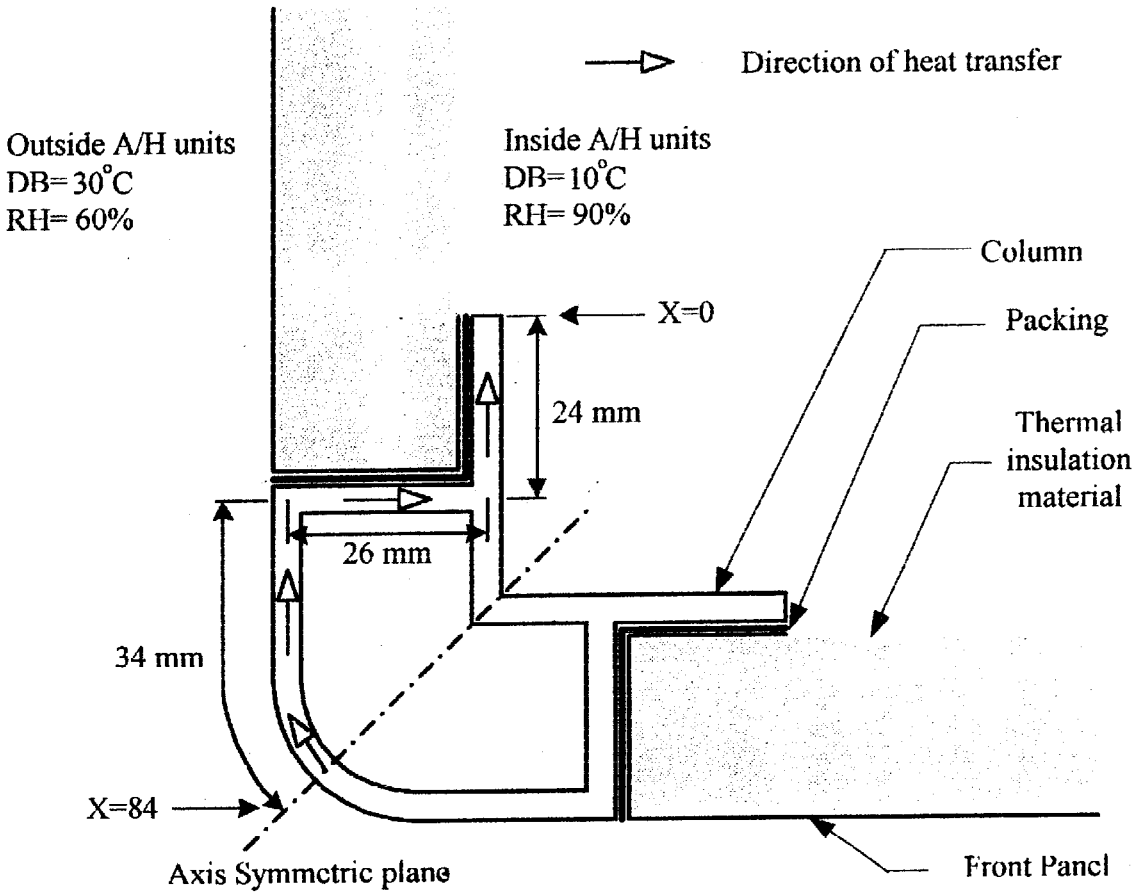
FIG. 6 is a fragmentary sectional view showing the plastic hollow angle column of the present invention subjected to a second thermal conduction test under temperature conditions of 10° C. inside and 30° C. outside the housing of the air handling units.
Figure 7:
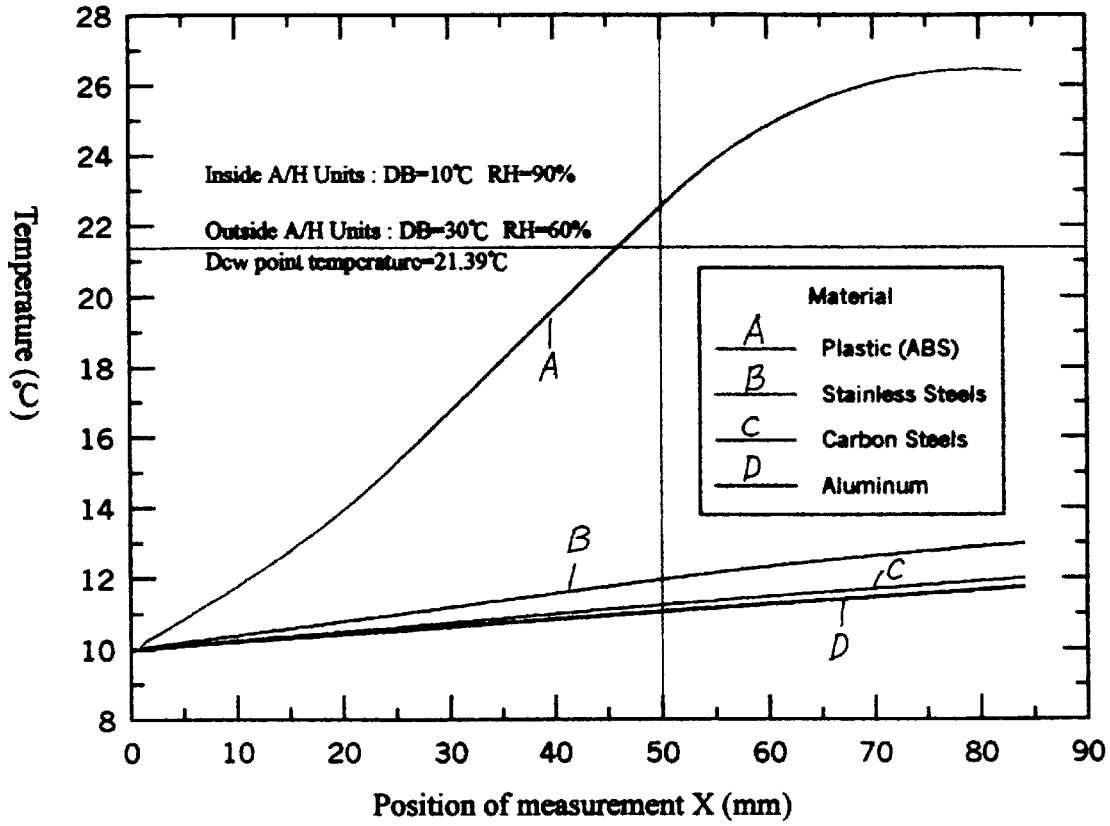
FIG. 7 is a graph comparing the influence of angle columns made of different materials on the condensation condition on the surfaces of the housing of the air-handling units under temperature conditions of 10° C. inside and 30° C. outside the housing of the air handling units.

A second specific thermal conduction test is conducted for housings of air-handling units with the respective frames thereof made of different materials, including plastic material as adopted by the present invention, under conditions of an ambient air dew point temperature of 21.39° C., and a dry bulb temperature of 10° C. and a relative humidity of 90% inside the housing of the air-handling units relative to a dry bulb temperature of 30° C. and a relative humidity of 60% outside the housing of the air-handling units. FIGS. 6 and 7 show the method and the results, respectively, of the second test.

In FIGS. 5 and 7, curves represent temperature distributions on the plastic hollow angle column of the present invention. As can be seen from the cross section of the angle column 6, X indicates a creepage distance between a point on the front surface of the angle column 6 and a point on the outer edge of one wing 63 in the same plane. In the first and the second tests, temperatures measured for any point on the plastic angle column 6 with the value of X larger than 45 mm (X>45 mm) are always above the ambient air dew point temperatures 18.58° C. and 21.39° C., respectively. This means there would not be any condensate on surfaces of the plastic angle column 6 of the present invention when it is used to construct the frame for a housing of air-handling units. On the other hand, blue curves in FIGS. 5 and 7 represent temperature distributions on an angle columns that is made of aluminum, one of the most commonly adopted conventional metal materials, for forming the housing of air-handling units. As indicated, temperatures measured in two tests at any point on the aluminum column having an X value larger than 45 mm (X>45 mm) all are around 10° C. to 11° C. This means the housing of the air-handling units has a dew point temperature lower than the ambient air dew point temperatures of 18.58° C. and 21.39° C., and it is inevitable there is condensate on the surfaces of the aluminum columns and the front panel 11.

In conclusion, the plastic hollow angle column 6 is proven to have the ability of completely and effectively solving the problem of condensate on surfaces of the housing of the air-handling units, and allowing the air-handling units to have increased air cooling efficiency with reduced power consumption. Moreover, the plastic hollow angle column 6 of the present invention provides internal close spaces 62. Since air in the close spaces 62 does not flow and is completely isolated from air outside the column 6 while having very low coefficient of thermal conduction of 0.02624 kcal/mhr, it forms another excellent heat insulator to help the plastic hollow angle column 6 maintain good insulation effect.

What is claimed is:

1. A frame for forming a housing of a group of air-handling units, said frame comprising a plurality of angle columns and a plurality of three-way unions for each joining three said angle columns extended in X-axis, Y-axis, and Z-axis directions; said angle columns being formed from a plastic material by extrusion and having a hollow main body, and said three-way unions being integrally formed from a plastic material by injection molding, and wherein said three-way unions each include a base defining three continuous front surfaces in X-axis, Y-axis, and Z-axis directions, and three connection legs integrally connected to said base and separately projected from a rear side of said three front surfaces; and three injection molded reinforcing plates being separately provided to root portions of said three connection legs in such a manner that said reinforcing plates provide positions between said three connection legs for front panels mounted on said frame to complete said housing of said group of air-handling units, and wherein said angle columns have laterally symmetrical structure and said hollow main body of said angle columns have an axially extended internal middle rib that divides an inner space of said hollow main body into two identical closed spaces.

2. A frame as claimed in claim 1, wherein said connection legs are each provided with a length of middle spacing slot corresponding to said middle rib in said hollow main body of said angle columns, such that when one said connection legs on said three-way unions are each inserted into said hollow main body of each of said angle columns, said middle spacing slot engages with said module rib.

3. A frame as claimed in claim 2, wherein said two identical closed spaces in said hollow main body of each of said angle columns have a contour corresponding to that of said connection legs and have dimensions slightly larger than that of said connection legs for said angle columns to connect to said three-way unions in a tight fit relation.

4. A frame as claimed in claim 3, wherein said angle columns include two axially extended reinforcing wings that radially project from a rear edge of said middle rib to contain a right angle between said two reinforcing wings.

* * * * *